US006558267B2

(12) United States Patent
Novosel, Sr.

(10) Patent No.: US 6,558,267 B2
(45) Date of Patent: May 6, 2003

(54) GOLF TRAINING AID

(76) Inventor: John M. Novosel, Sr., 12708 Pembroke La., Leawood, KS (US) 66209

( * ) Notice: Subject to any disclaimer, the term of this patent is extended or adjusted under 35 U.S.C. 154(b) by 0 days.

(21) Appl. No.: 09/946,103

(22) Filed: Sep. 4, 2001

(65) Prior Publication Data

US 2002/0032070 A1 Mar. 14, 2002

Related U.S. Application Data

(60) Provisional application No. 60/230,464, filed on Sep. 6, 2000.

(51) Int. Cl.[7] ..... A63B 69/36
(52) U.S. Cl. ..... 473/232
(58) Field of Search ..... 473/324, 232, 473/131, 292, 282, 238, 231, 233, 244, 219, 226, 409

(56) References Cited

U.S. PATENT DOCUMENTS 2,497,237 A 2/1950 Reineking
3,033,575 A * 5/1962 Hause
3,606,340 A 9/1971 Tiller
4,203,598 A * 5/1980 Stuff et al.
4,854,585 A 8/1989 Koch et al.
4,856,782 A * 8/1989 Cannan
4,889,343 A * 12/1989 Nielsen
5,205,561 A * 4/1993 Lux
5,255,994 A * 10/1993 Stein
5,277,059 A * 1/1994 Chastonay
5,277,427 A * 1/1994 Bryan et al.
5,338,035 A * 8/1994 Lyford
5,370,396 A * 12/1994 Bloom

* cited by examiner

*Primary Examiner*—Sebastiano Passaniti
(74) *Attorney, Agent, or Firm*—Robert M. Hunter

(57) ABSTRACT

A hinged golf training club having a hinge that pivots at a zero degree angle relative to the reference plane 42 of zero degree clubhead 32. The club looks substantially like and acts substantially like a conventional golf club in every way except for hinge 28, and allows the user to safely hit golf balls both on the range and on the course. This hinged training club 20 gives unmistakable positive feedback to the user both as how to use the hands, wrists and forearms in the golf swing to affect what has been popularly called the release of the club through the ball, and also gives the user exact, unmistakable three-dimensional feedback as to where the shaft is supposed to be throughout the swing in order to affect the correct swing.

24 Claims, 3 Drawing Sheets

Fig. 2.
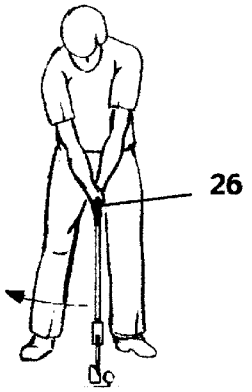
Fig. 3.
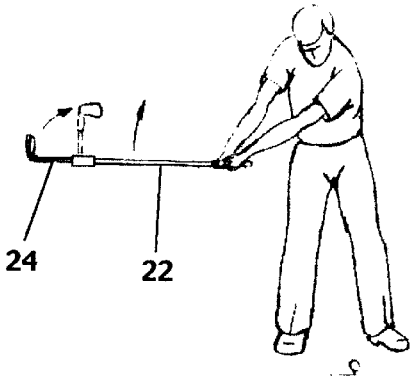
50
12.
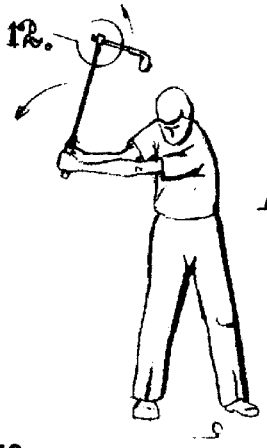
Fig. 4.
50
Fig. 5.
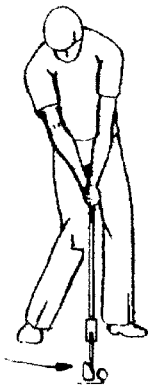
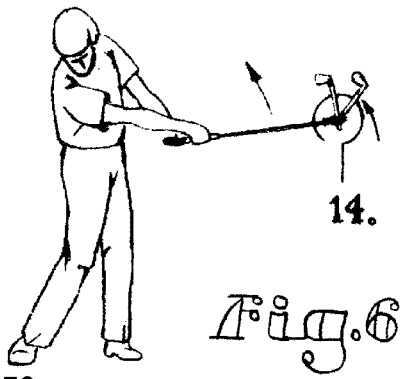
Fig. 6.
50
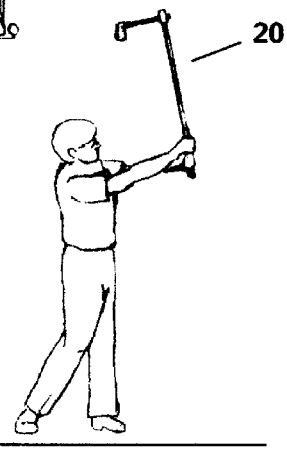
Fig. 1.
50

GOLF TRAINING AID

I claim the benefit of provisional Application No. 60/230/464 filed Sep. 6, 2000.

BACKGROUND—FIELD OF THE INVENTION

This invention relates to golf training aids, specifically to a golf swing training aid. Moreover, this invention relates to a hinged practice golf club that indicates to the golfer exactly how to use his hands, wrists and forearms in the golf swing to effect what has been popularly called the release of the club through the ball. In addition, it will give the golfer unmistakable three dimensional feedback as to the correct positioning of the golf shaft thruout the swing.

BACKGROUND—DESCRIPTION OF PRIOR ART

Through the years there have been many swing aids with a hinged design of the fork type being their main feature. Koch U.S. Pat. No. 4,854,585 and the others of his ilk basically tried to keep the golf club on the correct swing plane through the use of their clubs and the hinge would pivot or break if the club were to be taken back to fast and or off of the correct plane. With Reineking U.S. Pat. No. 2,497,237 and Koch U.S. Pat. No. 4,854,585 you could actually safely hit balls because they all had their hinges pivoting on a 90 degree angle relative to the reference plane of the club face. The reference plane of the club face is defined as the plane in which the club face of an iron having a 0 degree loft lies.

In most of these designs, the hinge is of a fork type; one hinge member has a pair of arms forming a fork, the other hinge member has a single arm (or tongue) which is received within the fork, and a pivot pin passes transversely through all three arms. These were easily constructed because the only stress vectors at the 90 degree angle were on the pivot pin and not on the forked sides.

All of these forked hinge designs would fail if they were turned to a 0 degree angle relative to the reference plane of the 0 degree clubhead because there is no reinforcement at the bottom of the fork. In other words, when the golfer would swing and impact a ball or the earth at clubhead speeds in the neighborhood of 100 mph, the leverage exerted upon the inner sides of the fork member by the tongue member would cause the forked members to bend or fail. This failure would present a hazard to the user and any onlookers, as the clubhead could become separated from the shaft and fly through the air.

Lyford U.S. Pat. No. 5,338,035 was obviously aware of this forked hinge limitation and has marketed his invention with the club face coated with a rubber coating so that you could not hit balls with it.

Tiller U.S. Pat. No. 3,606,340 was the exception as his fork design was set at a reference angle of 0 degrees. Obviously the drawings in Tiller U.S. Pat. No. 3,606,340 preclude hitting balls with the instrument as the forked hinge design shown would not hold up to the constant pounding of balls and earth that it alludes to. Also, if the hinge is to mirror the positions that the hands, wrists and forearms get into, then the hinged portion should not move both upwardly and downwardly as the wrists never deviate downwardly from the position of address as taken in the full golf swing. What is desirable in such a hinge is that it only hinge upwardly. Also there is no evidence that Tiller U.S. Pat. No. 3,606,340 ever was commercialized.

Unfortunately, to be correct, the angle for the hinge must be 0 degree angle relative to the reference plane of the 0 degree clubhead, if it is to mirror and give exact, user understandable feedback as to the correct action of the hand, wrists and forearms in the golf swing. If the hinge is to exactly mirror the wrists in the full swing, then it must also only hinge upwardly, as that is how the wrists work. It also must be at this angle if you are to give exact, unmistakable three dimensional feedback as to where the shaft is to be thruout the swing in order to effect the correct swing plane.

So basically there have been no hinged golf training aids that pivoted at a 0 degree angle relative to the reference plane of the 0 degree clubhead, and with a safe construction that you could actually hit balls without presenting a safety hazard to the user and onlookers, and further, that looked exactly like and acted exactly like a conventional golf club in every way except for the hinge. Also there have been no hinged golf training clubs that would give unmistakable positive feedback to the user both as how to use the hands, wrists and forearms in the golf swing to effect what has been popularly called the release of the club through the ball, and that would also give the user exact, unmistakable three dimensional feedback as to where the shaft is to be thruout the swing in order to effect the correct swing.

It would also be helpful to have the additional feedback of the actual ball flight as you performed the correct motion.

Yet another object of the present invention is to provide a training club that can be used anywhere with or without a golf ball and that can actually be taken out on the course and be used for playing shots if desired.

Other objects will become apparent as the specification proceeds.

DESCRIPTION OF THE DRAWINGS

FIG. 2 shows the golfer addressing the golf ball with the training club.

FIG. 3 shows the golfer pronating his left hand and forearm and supinating his right hand and forearm as the club is raised articuately away from the ball. As the club is raised away from the ball, it rotates 90 degrees and the lower pivot portion rises, provided the planar swing is carried out.

FIG. 4 shows the top of the swing, again on the correct plane, the golfer's left arm essentially straight and parallel to the ground. The pivot has hinged so that this part of the shaft is pointing to the target.

FIG. 5 is a view showing the swing back to the ball from FIG. 4, going through the reverse step of FIG. 3, where, if the swing plane is maintained, the pivoted portion of the lower club goes back to the straight position seen in full lines in FIG. 3, so that the ball strike can be made.

FIG. 6 is a view in which we have the exact opposite of FIG. 3 occurring. That is, as the right hand and forearm pronate and the left hand and forearm correctly supinate at the same time, then the pivotal portion of the golf club swings up as shown at FIG. 13.

FIG. 7 is a view of the correct swing completed with the entire part of the club and the arms of the player in the circular plane described.

REFERENCED NUMERALS IN DRAWING

Figure 1:
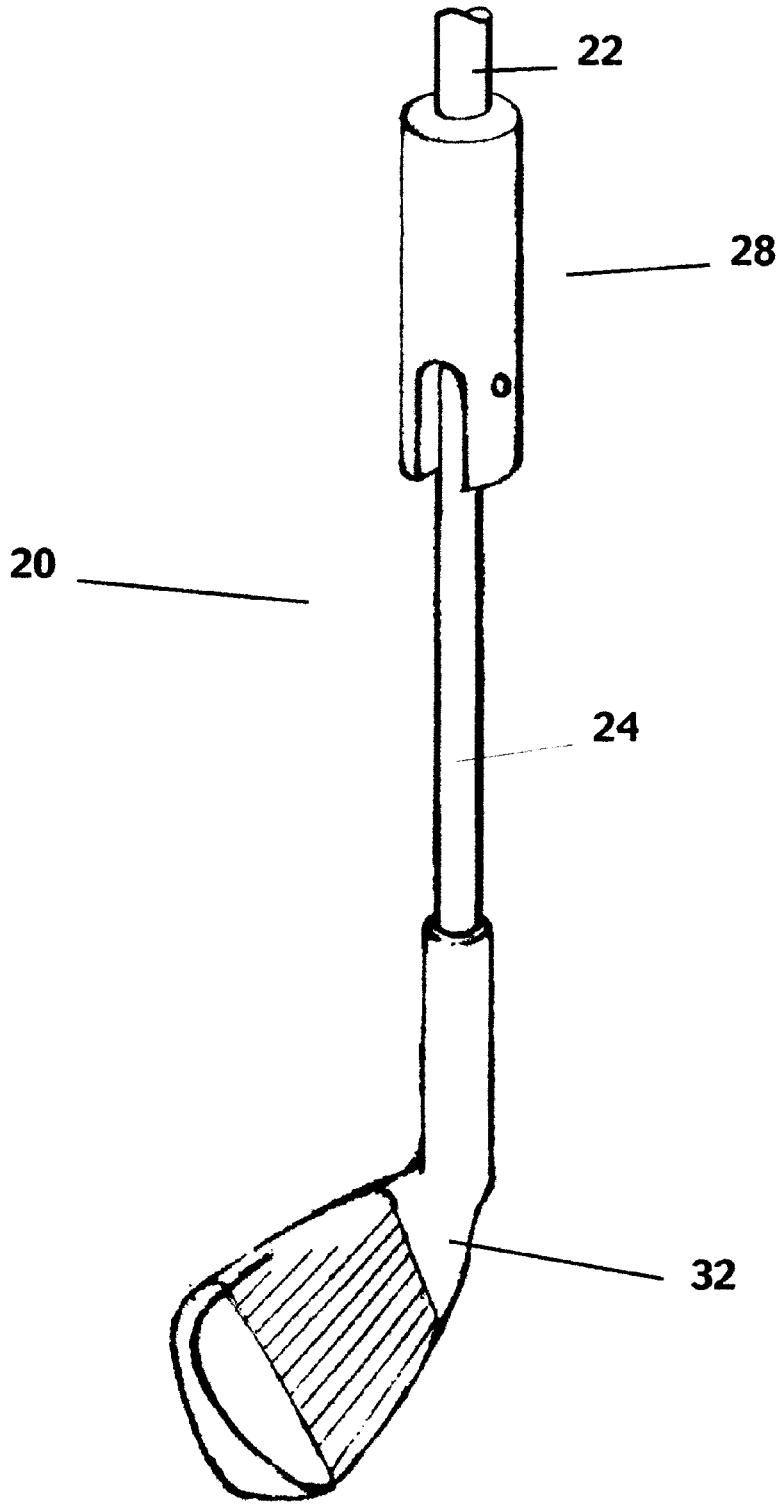
FIG. 1 is a three-quarter perspective view from the front of the iron golf club, showing enough of the shaft to include the pivot device.
Figure 8:
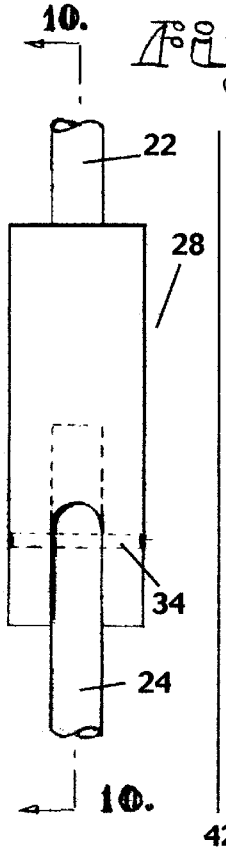
FIG. 8 is a front view showing the pivotal connection, per se, seen at the top of FIG. 1 with the lower portion of the club depending downwardly, just as seen in FIG. 1.
Figure 9:
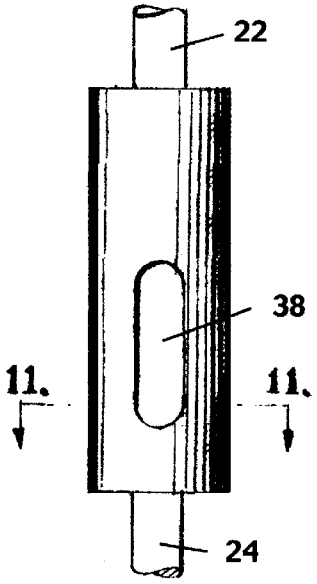
FIG. 9 is a view showing the reverse side of FIG. 8 and shows the recess in the opposite side of the coupling where the rear end of the lower pivotal part of the club can pass out through the collar that has the roll pin, permitting the lower golf club portion to pivot.
Figure 10:
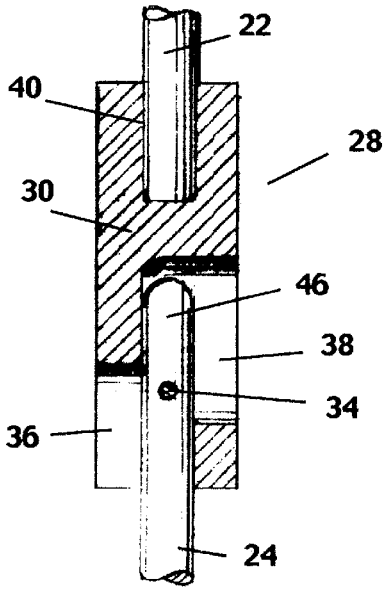
FIG. 10 is a view taken along 10—10 of FIG. 8 in the direction of the arrows.
Figure 11:
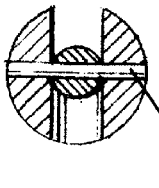
FIG. 11 is a view taken along the lines 11—11 of FIG. 9 in the direction of the arrows.
Figure 12:
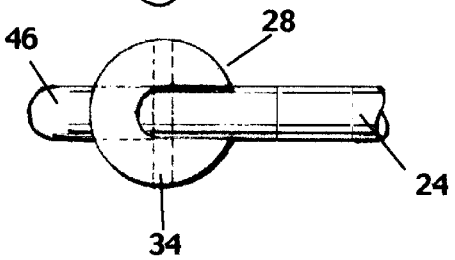
FIG. 12 is a view showing the shaft, pivot and collar with the lower portion of the golf club fully pivoted.
Figure 13:
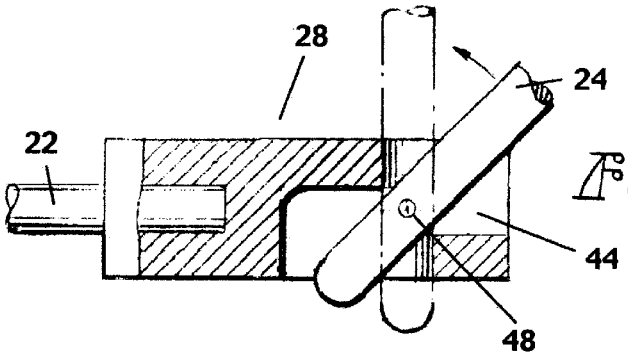
FIG. 13 is a view taken along the line 14 of FIG. 6 in the direction of the arrows. The slot seen in FIG. 9 is downwards and the front face slot of FIG. 1 is upwards.

20 Hinged golf swing training device
22 Elongated longer upper portion of shaft
24 Elongated shorter lower portion of shaft
26 Grip
28 Hinge assembly
30 Female hinge member
32 Clubhead
34 Roll pin
36 Front face slot
38 Back face slot
40 Shaft cavity
42 Reference plane
44 Lower shaft receiving groove
46 Male hinge member
48 Roll pin bore
50 Target line

DETAILED DESCRIPTION

Referring initially to FIGS. 1–7, there is shown a golfer at address in FIG. 2 with the present invention, a hinged golf swing training club 20. It has the usual elongated upper 22 and lower 24 shaft sections, connecting at their confronting ends by a hinge assembly 28 having one distinct hinge axes.

At the end of the longer upper 22 end thereof, a grip 26 is provided which is to be walls that are simultaneously strengthened by the presence of the third connecting wall at the time of greatest stress which is impact with the ball when the hinging assembly snaps back into the alignments in which it was at address. With the prior art, there are only the two forked open-sides to absorb the stress and often bend or break with the result being dangerous conditions for the swinger and onlookers.

Practice with the training club 20 of the present invention is illustrated by the sequence of views of FIGS. 2–7. To get to the top of the backswing in FIG. 4, normally the golfer would have to think about keeping his left arm straight and pronated, the right arm supinated and in flexion, with both wrists in radial flexion, the left wrist in palmar extension and the right wrist in extension. In order to arrive at the finish illustrated in FIG. 7, the golfer would have to think about supinating the left arm and pronating the right arm so that they would arrive with the left arm in flexion and the right arm relatively straight, with both wrists in radial flexion, the left wrist in palmar extension and the right wrist in extension. Instead of thinking about all of that, and since the hinge assembly 28 mirrors exactly what the golfers wrists are doing, all the golfer has to do is get the training club 20 in the positions shown in FIGS. 3 to 7 to check if they have made the correct movements with their body.

The first checkpoint is at FIG. 3. To check if the golfer is in the correct position for this part of the swing, they would make sure that when the upper 22 portion of the shaft of the club 20 becomes parallel with the ground that it is also parallel to the target line 50 and that the handle of the shaft is generally over the toes of the right foot. The lower 24 section of the shaft would be perpendicular to the ground if the hinge assembly 28 were fully cocked at this time. Fully cocked would mean that lower 24 section of shaft and upper 22 section of shaft would form a 90 degree angle. Any deviation from either of these checkpoints would indicate that the golfer would have to adjust his bodily movements to effect the correct position of the club 20. The next checkpoint is at FIG. 4. The golfer should check that upper 22 portion of shaft is pointing at the target line 50 and that the lower 24 portion of the shaft is pointed at the target. When the golfer arrives at FIG. 5 the upper 22 and lower 24 sections of the shaft should have come back into the same alignment as at address for impact and then continue to FIG. 6 where the upper 22 portion of the shaft would again be parallel to the ground and the target line 50. In addition, the lower 24 section of the shaft would be perpendicular to the ground if the hinge assembly 28 were fully cocked at this time, with the handle of the shaft generally over the toes of the left foot.

At the finish, the golfer should check that the upper 22 portion of the shaft is pointing at the target line 50 and that the lower 24 portion of the shaft is pointed at the target. If the golfer deviates from these checkpoints, for example, the position of the club 20 at FIG. 6 is not as prescribed, then he must adjust his bodily movements to effect the simple corrections in order to get the swing onto the proper plane and correct release as exhibited by touring professionals.

Thus we can see that this training club 20 provides the golfer with unmistakable feedback, since it exactly mirrors the motion of his hands, wrists and forearms. In addition, the upper 22 and lower 24 sections of the shaft provide unmistakable feedback by the way they line up in the various checkpoints of the swing. We can see further that this training club 20 allows the golfer to feel the correct release of the golf training club 20 through the ball with the additional feedback of being able to observe ball flight after the swing. This will allow both inexperienced and scratch golfers to improve their ball striking abilities.

I claim:

1. A golf training aid comprising:

an upper shaft section having a grip;

a lower shaft section having a clubhead having a reference plane; and a one-way hinge assembly comprising a female hinge member that is fixed to said upper shaft section and a male hinge member that is fixed to said lower shaft section and that is pivotably connected to said female hinge member;

wherein said female hinge member comprises a longitudinal cavity within which said male hinge member pivots about a transverse axis, said transverse axis being perpendicular to the reference plane of a clubhead having a zero degree loft, said cavity being formed by two outer walls that are connected at their lower ends by a third wall, said third wall being operative to prevent pivoting of the male member by more than about 90 degrees.

2. The golf training aid of claim 1 further comprising a roll pin about which male hinge member pivots.

3. The golf training aid of claim 1 wherein said clubhead is selected from the group consisting of:

an iron, a driver, and a training head.

4. The golf training aid of claim 1 in which the hinge assembly is located at or near the center of gravity of the golf training aid.

5. A golf training aid comprising:

an upper shaft section having a grip;

a lower shaft section having a clubhead; and a hinge assembly comprising a female hinge member that is fixed to said upper shaft section and a male hinge member that is fixed to said lower shaft section and that is pivotably connected to said female hinge member;

wherein said female hinge member comprises a longitudinal cavity within which said male hinge member pivots about a transverse axis, said cavity being formed by two outer walls that are connected at their lower ends by a third wall and at their upper ends by a fourth wall.

6. The golf training aid of claim 5 wherein said hinge assembly is a one-way hinge assembly the constrains said lower shaft section to pivot away from a plane that is parallel to said transverse axis and that intersects said side third wall.

7. The golf training aid of claim 5 wherein said third wall and said fourth wall are operative to prevent pivoting of the male member by more than about 90 degrees.

8. The golf training aid of claim 5 in which the components of said training aid are not substantially different from those of the traditional and customary form and make of golf club.

9. The golf training aid of claim 5 wherein said grip is selected from the group consisting of:

a grip that is not substantially different from the traditional and customary form and make of golf club grip, and a training grip.

10. The golf training aid of claim 5 in which said female hinge member contains a shaft cavity for receiving the lower end of said upper shaft portion.

11. The golf training aid of claim 5 in which said male hinge member and said female hinge member contain bores that accept a roll pin.

12. The golf training aid of claim 5 wherein the lower end of male hinge member is configured to fit into the hollow core of said lower shaft section.

13. The golf training aid of claim 5 configured so that the longitudinal axes of upper shaft member and lower shaft member are aligned when a ball is addressed and when the ball is struck during a proper golf swing.

14. The golf training aid of claim S wherein the longitudinal axis of said male hinge member and the longitudinal axis of said female hinge member are oriented at a 90 degree angle when said hinge assembly is fully cocked.

15. A method for training a golfer to execute a proper golf swing using a training aid comprising an upper shaft section having a handle and a lower shaft section having a clubhead, said upper and lower shaft sections being joined by a one-way hinge assembly, said method comprising:

addressing the ball, at which time said upper shaft section and said lower shaft section are in alignment;

executing a first part of a backswing to a first checkpoint at which said upper shaft section is parallel to the ground and parallel to a line to the target, said handle is generally over the toes of the right foot, and said lower shaft section is fully cocked;

continuing the backswing to a second checkpoint at which the upper end of said upper shaft section is pointing at the target line, said lower end of lower shaft section is pointing at the target;

executing a first part of a forward swing to a third checkpoint at which said upper shaft section and said lower shaft section are in alignment;

continuing the forward swing to a fourth checkpoint at which said upper shaft section is parallel to the ground and the target line, said handle is generally over the toes of the left foot, said lower shaft section is fully cocked; and continuing the forward swing to a fifth checkpoint at which the upper end of said upper shaft section is pointing at the target line and the upper end of said lower shaft section is pointing at the target.

16. The method claim 15 wherein addressing the ball comprises orienting the training aid so that the target is located in a plane that is perpendicular to a reference plane of a zero degree clubface.

17. The method claim 15 wherein the lower shaft section is oriented at a 90 degree angle to the upper shaft section at the first checkpoint.

18. The method claim 15 in which contact with a golf ball occurs at the third checkpoint.

19. The meth od claim 15 wherein the lower shaft section is oriented at a 90 degree angle to the upper shaft section at the fourth checkpoint.

20. The method claim 15 further comprising having an observer report to the golfer the orientation of the components of the training aid at each checkpoint after the swing is completed.

21. A golf training aid comprising:

an upper shaft section having a grip;

a lower shaft section having a clubhead having a reference plane; and a one-way hinge assembly comprising a female hinge member that is fixed to said upper shaft section and a male hinge member that is fixed to said lower shaft section and that is pivotably connected to said female hinge member;

wherein said female hinge member comprises a body having a longitudinal cavity within which said male hinge member pivots about a transverse axis, said transverse axis being approximately perpendicular to the reference plane of a clubhead having a zero degree loft, said cavity being formed by two outer walls that are connected at their lower ends by a third wall.

22. A golf training aid comprising:

an upper shaft section having a grip;

a lower shaft section having a clubhead; and a hinge assembly comprising a female hinge member that is fixed to said upper shaft section and a lower shaft section having an upper end that is pivotably connected to said female hinge member;

wherein said female hinge member comprises a body having a longitudinal cavity within which said upper end pivots, said cavity being formed by two outer walls that are connected at their lower ends by a third wall and at their upper ends by a fourth wall.

23. The golf training aid of claim 22 wherein said fourth wall is operative to prevent pivoting of said lower shaft by more than about 90 degrees with respect to said upper shaft.

24. A golf training aid comprising:

an upper shaft section having a grip;

a lower shaft section having a clubhead; and a hinge assembly comprising a female hinge member that is fixed to said upper shaft section and a lower shaft section having an upper end that is pivotably connected to said female hinge member;

wherein said female hinge member comprises a body having a longitudinal cavity within which said upper end pivots, said cavity being formed by two outer walls that are connected adjacent to their upper ends by a fourth wall and adjacent to their lower ends by a third wall that forms a forward-facing groove in the lower portion of said body and a backward-facing slot in the upper portion of said body.

* * * * *